United States Patent [19]

Widen

[11] 4,296,619

[45] Oct. 27, 1981

[54] ANCHORING MEANS FOR DOOR LOCK PLATES

[75] Inventor: Bo G. Widen, Torshälla, Sweden

[73] Assignee: GKN-Stenman AB, Eskilstuna, Sweden

[21] Appl. No.: 105,490

[22] Filed: Dec. 20, 1979

[30] Foreign Application Priority Data

Dec. 29, 1978 [SE] Sweden ..... 7813472

[51] Int. Cl.[3] ..... E05B 9/08

[52] U.S. Cl. ..... 70/451; 70/452

[58] Field of Search ..... 70/451, 452, 450, 370

[56] References Cited

U.S. PATENT DOCUMENTS 1,110,725 9/1914 Stone ..... 70/452

FOREIGN PATENT DOCUMENTS 1190930 5/1970 United Kingdom ..... 70/452

*Primary Examiner*—Robert L. Wolfe

*Attorney, Agent, or Firm*—Sughrue, Mion, Zinn, Macpeak and Seas

[57] ABSTRACT

A lock plate (2) is secured to a door (1) or the like, by means of two upper and two lower securing means (4,5). A recess formed in one side edge (1*b*) of the door is arranged to accommodate a lock housing (10) having a lock pillar (12) which covers the recess. The lock pillar (12) is secured by an upper and a lower screw (6) which simultaneously serve as anchoring elements to lock the plate securing means against rotation. Each of the securing means comprises a screw-thread (5) provided with an opening or recess (5*d*) and co-operating with a screw element (4) which is non-rotatably received in a hole in the plate (2). Each of the anchoring screws (6) is passed through two screw-threaded sleeves (5) provided with recesses and located on mutually the same level. The anchoring screws (6) co-act with two sleeve parts (7,8) which partially surround said screws, of which sleeve parts one (7) is screw-threaded for engagement with the screw thread. The sleeve parts (7,8) are introduced into the spaces located between the upper side and underside respectively of the lock housing and adjacent surfaces defining the recess (1*c*) for the lock housing.

9 Claims, 3 Drawing Figures

ANCHORING MEANS FOR DOOR LOCK PLATES

The present invention relates to door-lock plates, and more particularly to means for securing said plate to a door in a manner which makes it considerably difficult for a lock to be forced by first removing said plate, or which completely prevents the success of such an attempt.

Differing arrangements for securing a door plate are known to the art. For example, the German Patent specification No. 727.133 describes means for attaching a door plate by inserting elements from the door-post side of said door. The object of this arrangement is, inter alia, to centre the door knob relative to the lock follower. This arrangement does not provide for the reliable anchorage of the plate itself.

The German Lay-out print No. 2.549.858 describes a manner of anchoring door plates on the mutually opposite sides of a door by inserting screw elements through the lock housing, said lock housing being secured in a conventional way via the lock pillar. The screw elements inserted through the two plates can, however, be rendered inactive comparatively easily, and hence this arrangement is not fully reliable preventing the lock being forced.

The Swedish Patent specification No. 381.300 describes means for securing a door fitting by means of securing devices which—when the door is closed—cannot be reached from any side of the door. This type of securing means is mainly intended for locks and the like, and cannot be used, for example, in the case of door plates for lock housings having mortise locks.

The German Lay-out print No. 1.089.296 describes a comparatively complicated arrangement, in which the door plates have no screws which can be turned from the outside of the plate on both sides of the door, and in which the plate securing means co-operate with anchoring elements passed through the pillar side of the lock into the lock housing. A special part of this arrangement includes an arrangement of bearing brushes for the door knob, which simultaneously permit the lock to be adjusted in the door. The arrangement is unnecessarily expensive and complicated, and cannot be used in door locks and plates of standard design.

The German Patent specification No. 344.820, published 1920, describes anchoring means for door-lock plates where the lock is secured to a door by means of at least one upper and one lower securing means, said door having arranged therein a lock housing which is accommodated in a recess formed in a side edge adjacent the door plate and covered by a lock pillar, each of the securing means co-operating with an anchoring element inserted from the post side of the door. In this known anchoring arrangement, the plate securing means comprise projections or lugs extending perpendicular to the plane of said means and being inserted into corresponding recesses in the door, said projections or lugs exhibiting a line of holes which co-operate with a screw inserted from the pillar side of the lock. The arrangement, however, if comparatively weak, and hence it is not difficult to insert a tool between the plate and the door and force the plate away therefrom.

The object of the present invention is to provide a simple and effective anchoring means which eliminates the aforementioned disadvantages of known arrangements and which can be readily mounted on new and used lock arrangements with associated plates, without requiring complicated and expensive accessories.

An anchoring arrangement according to the present invention which fulfils this object is mainly characterized in that the securing means comprise a rotatable part which is held non-rotatably fixed by the anchoring element inserted from the pillar side.

Because the securing means—which can be firmly inserted and tightened so hard that they positively hold the plate to the door—are held non-rotatably fixed by the anchoring elements, which cannot be reached when the door is closed, any attempt to remove the plate by rotating the securing means is made impossible. The securing and anchoring means may be of simple design but, nevertheless, offer a high degree of safety. Neither is it difficult to install the securing and anchoring means, since both the plate and the lock pillar must hve some form of mounting devices, which fact, in accordance with the preferred embodiment of the invention, is utilized when applying the invention. Thus, eventhough the anchoring elements inserted from the pillar side of the lock may be independent of the lock-pillar securing means, it is preferred that the same elements are used both for securing the lock post and for securing the plate securing means. In this way, the possibility is also afforded of utilizing the upper part or lower part of the lock housing, e.g. for guiding purposes in conjunction with the anchoring operation.

The plate securing means can be non-rotatably fixed in a simplest manner by means of an anchoring element which is passed through a recess in the rotatable part of the securing means.

To this end, the rotatable part may suitably comprise a screw-threaded sleeve provided with said recess and a screw-head, said sleeve being arranged to co-operate with a screw element non-rotatably passed into a hole in the plate.

In this embodiment, a door plate is secured on each side of the door by passing the screw-threaded sleeve through a hole in one of said plates while the screw element is passed through a hole in the other of said plates, said screw element having a ring of tooth-like elements around the circumference thereof, said teeth-like elements being of a square, hexagonal or like shape and being arranged to co-operate with a projection of similar configuration extending from the inner surface of said hole. When tightening the screw-threaded sleeve on the screw element, it is ensured that the recess or opening in said sleeve faces towards the anchoring element which is inserted through the pillar-side of the lock, said anchoring element entering said opening in a manner to lock the screw-threaded sleeve against rotation.

In practice, the plates are secured by two upper and two lower securing means, this affording the best mode of securing the plates. The invention also affords the possibility of using one and the same anchoring element for locking the two upper securing means against rotation, and a further anchoring element for the two lower securing means.

As beforementioned, each of the two anchoring elements includes a screw which is also used to secure the lock pillar to the side edge of the door.

In a preferred embodiment applied in practice, each of the screws is at least partially encircled by a two-part sleeve with one part on each side of one of the securing means of the plate, and the threads of the screw in engagement with a thread in the remote sleeve part relative to the screw head. Because the plate securing means are held tightly between the two sleeve parts, of which one abuts the inside of the lock pillar, a further improved anchorage is obtained. The sleeve parts may exhibit at least one planar side which abuts, either directly or indirectly, the upper part or bottom of the lock housing. Thus, the lock housing also contributes to guiding and strengthening the construction.

Further, a planar sleeve part may be caused to abut the upper or lower defining surface of the recess accommodating the lock housing in the door. Thus, the sleeve parts of the two anchoring elements are accurately wedged between said surfaces and the upper and lower part of the lock housing.

To this end, the sleeve parts of said anchoring elements conveniently have a rectangular cross sectional shape.

The screw of respective anchoring elements projects out on the other side of the screw-threaded sleeve part and enters a recess arranged in a further securing means, locking the same against rotation.

An exemplary embodiment of the invention will now be described with reference to the accompanying drawing.

Figure 1:
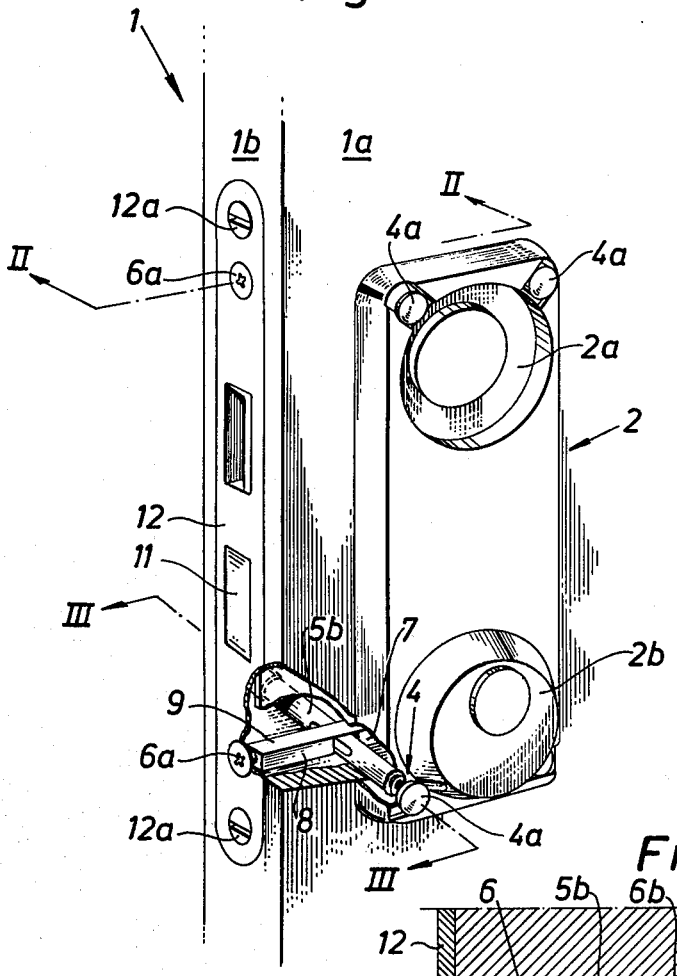
FIG. 1 is a partially cut-away perspective view of part of a door provided with a door plate secured and anchored in accordance

In FIG. 1 there is illustrated a door 1 having a door plate 2 arranged on one side thereof. The plate 2 has an upper hole 2*a* for receiving a door knob, and a lower cylindrical attachment in the form of a drill-shield 2*b* which encloses a cylinder lock (not shown). The cylinder lock is arranged to co-operate with a mechanism in a lock housing 10 (FIG. 2) having a bolt 11 extending through a lock pillar 12 in the side edge 1*b* of the door. The lock 10 is accommodated in a recess 1*c* in the door (FIG. 2) in a conventional manner.

The plate 2 is secured to the door by means of two upper and two lower securing means, each having the form of a screw element 4 arranged to cooperate with a respective screw-threaded sleeve 5. The screw element 4 has a flat head 4*a*, a sleeve part 4*b* and a screw-thread part 4*c*. Arranged behind the head 4*a* is a toothed part 4*d* which is arranged to co-act with a corresponding tooth-like element arranged in a hole in the plate 2 such that the screw element is locked against rotation in said hole.

The screw-threaded sleeve 5 has a head 5*a* having a slot 5*c* arranged therein, a sleeve part 5*b* and a through-passing elongate hole 5*d*. When tightening the sleeve 5 on the screw element 4, a plate 2 is secured on each side of the door.

The lock pillar 12 is secured by means of two screws 12*a*. Two securing devices 6 serve as anchoring elements for locking two sleeves 5*b* of the plate-securing means 4,5 against rotation.

To this end each of the anchoring elements 6 exhibits a head 6*a* having a groove arranged therein, a non-threaded part 6*b* which is passed through the hole 5*d* in a respective sleeve 5, a screw-threaded part 6*c* which measures with the thread of a sleeve part 7 surrounding said screw, said sleeve part 7 being of rectangular cross section. The end of the screw-threaded part 6*c* extends out of the sleeve part 7 and enters the elongate hole 5*d* of the sleeve part 5*b* of a further plate-securing means 4,5.

The end part of the screw 6 nearest the head is passed through a sleeve part 8, which is also of rectangular cross section. When tightening the screw 6, the sleeve 5*b* will thus be held clamped in a direction towards the lock pillar 12, between the two sleeve elements 7 and 8. At the same time, the screws 6 hold the respective screw-threaded sleeves locked against rotation in the aforedescribed manner.

Figure 2:
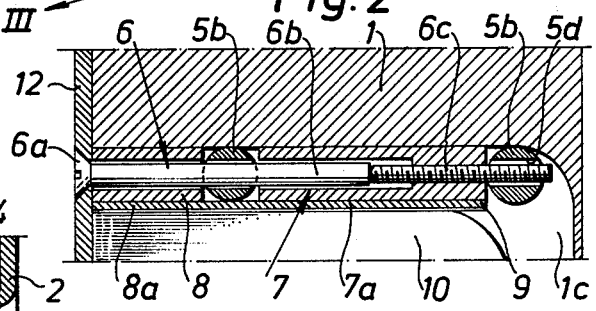
FIG. 2 is a sectional view taken on the line 2—2 in FIG. 1.
Figure 3:
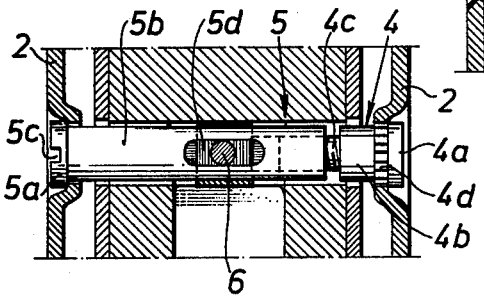
FIG. 3 is a sectional view taken on the line 3—3 in FIG. 1.

In the arrangement illustrated in FIG. 2, the sleeve parts 7 and 8 are inserted between the upper planar defining surface of the recess 1*c* in the door and the upper surface of the lock housing 10. A flat element 9 made of sheet metal or some other suitable material is inserted between the sleeve parts and the lock housing, to take up the clearance. The screw-threaded sleeve part 7 is, at the same time, held against rotation when screwing in the anchoring screw 6.

The lower anchoring arrangement is of a corresponding construction. In this case, the sleeve parts 7 and 8 are inserted between the lower defining surface of the recess 1*c* and the bottom surface of the lock housing 10.

It will be understood that other kinds of anchoring elements can also be used for locking against rotation the means used to secure a door plate on one or both sides of the door. These securing means may also have a form different to that illustrated and described. The lateral stiffening imparted to the securing means in addition to the non-rotatable locking function, constitutes an important safety factor of the plate-securing arrangement.

I claim:

1. An anchoring arrangement for a door plate of a lock, said plate being secured to a door or the like by means of at least one upper and one lower securing means, said door accommodating a lock housing secured in a recess formed in a side edge of the door adjacent said plate and covered by a lock pillar, said securing means each cooperating with an anchoring element inserted from the pillar side of the door, said securing means including a rotatable part which is locked against rotation by the anchoring element inserted from the lock-pillar side of the door, each of said anchoring elements comprising a screw, and wherein said screws also secure the lock pillar to the side edge of the door.

2. An anchoring arrangement according to claim 1, wherein said anchoring element is passed through a hole in the rotatable part.

3. An anchoring arrangement according to claim 2, wherein said rotatable part comprises a screw-threaded sleeve provided with an opening and a screw-head.

4. An anchoring arrangement according to claim 3, wherein said screw-threaded sleeve co-operates with a screw element non-rotatably passed through a hole in the door plate.

5. An anchoring arrangement according to claim 1, wherein said screws are at least partially enclosed by a two-part sleeve having a part on each side of a securing means, the thread of each screw meshing with a thread in the remote sleeve part relative to the screw head.

6. An anchoring arrangement according to claim 5, in which said plate is secured by means of two upper and two lower securing means, wherein one anchoring element screw is passed through the two upper securing means, a further anchoring element screw is passed through the two lower securing means, and the end of each screw extends beyond its associated two-part sleeve and enters the second upper and second lower securing means, respectively.

7. An anchoring arrangement according to claim 5, wherein at least one of said sleeve parts has at least one planar side which engages, either directly or indirectly, the upper part or bottom part of the lock housing.

8. An anchoring arrangement according to claim 7, wherein said at least one sleeve part further has at least one planar side which engages, either directly or indirectly, a surface defining the recess for accommodating the lock housing.

9. An anchoring arrangement according to claim 5, wherein the end of the screw extends from the other side of the screw-threaded sleeve part and enters a recess or opening of a further securing means to lock the same against rotation.

* * * * *